US008356953B2

(12) United States Patent
Sagel

(10) Patent No.: US 8,356,953 B2
(45) Date of Patent: Jan. 22, 2013

(54) ROTARY FITTING FOR A CORNER CUPBOARD

(75) Inventor: Claus Sagel, Bielefeld (DE)

(73) Assignee: Vauth-Sagel Holding GmbH & Co. KG, Brakel (DE)

( * ) Notice: Subject to any disclaimer, the term of this patent is extended or adjusted under 35 U.S.C. 154(b) by 260 days.

(21) Appl. No.: 12/956,508

(22) Filed: Nov. 30, 2010

(65) Prior Publication Data

US 2011/0127228 A1 Jun. 2, 2011

Related U.S. Application Data

(60) Provisional application No. 61/265,448, filed on Dec. 1, 2009.

(51) Int. Cl.
*B25G 3/00* (2006.01)

(52) U.S. Cl. ..... 403/348; 211/144

(58) Field of Classification Search ..... 211/144, 211/163, 77, 78, 95, 196, 166, 205, 177, 211/133.4; 312/238, 305; 108/94, 95; 403/348, 403/350, 194, 195, 197, 240, 243, 104, 106, 403/107

See application file for complete search history.

(56) References Cited

U.S. PATENT DOCUMENTS 4,181,037 A * 1/1980 Boon et al. ..... 74/569
4,440,459 A * 4/1984 Hallgren ..... 312/238
4,566,350 A * 1/1986 Miyamoto et al. ..... 74/526
4,736,945 A * 4/1988 Vinciguerra ..... 482/82
4,878,695 A * 11/1989 Whitham ..... 285/39
5,133,617 A * 7/1992 Sokn et al. ..... 403/349
5,279,429 A 1/1994 Sagel
2005/0063772 A1* 3/2005 Bladen ..... 403/348
2009/0311041 A1* 12/2009 Sockman et al. ..... 403/348

OTHER PUBLICATIONS

Product Literature entitled Rev-A Shelf, located at http://www.kitchensource.com/lazy-susan/pm-Is-fullround-polymer2.htm, printed (1 Page), found Aug. 24, 2009.

* cited by examiner

*Primary Examiner* — Jennifer E. Novosad
(74) *Attorney, Agent, or Firm* — Thomas | Horstemeyer, LLP

(57) ABSTRACT

A rotary fitting for a corner cupboard comprises a supporting column; fastening members for the supporting column; an article-carrying member rotating about the supporting column; and a rotary bearing between the supporting column and the article-carrying member. The rotary bearing has a first component mounted on the supporting column and having an upper side with at least three circular tracks that extend round the supporting column, and comprise two opposite sloping regions arranged between a lower portion and an upper portion of the track each, the sloping regions which slope in the same direction of all circular tracks being distributed around the supporting column; and a second component mounted on the article-carrying member and having an underside on which one complementary circular track having lower and upper portions and opposite sloping regions is provided per each circular track on the upper side of the first component.

25 Claims, 4 Drawing Sheets

ROTARY FITTING FOR A CORNER CUPBOARD

CROSS REFERENCE TO RELATED APPLICATIONS

The present application claims priority to U.S. Provisional Patent Application Ser. No. 61/265,448 entitled "Drehbeschlag für einen Eckschrank", filed Dec. 1, 2009.

FIELD OF THE INVENTION

The invention relates to a rotary fitting for a corner cupboard. In particular, the invention relates to a rotary fitting of the Lazy Susan type for a corner cupboard, in which article-carrying members, such as shelves or baskets for example, are not circular but have a cut-out which has to be brought to a defined position to allow the corner cupboard to be closed.

BACKGROUND ART

A rotary fitting for a corner cupboard is known from U.S. Pat. No. 5,279,429, in which, on the upper side of a first rotary bearing component, a substantially horizontal circular track having a single rounded projection and, on the underside of a second rotary bearing component, a circular track having a single recess corresponding to the projection there are provided. The first rotary bearing component is provided in a fixed position on a fastening member for a supporting column by which the supporting column is held in the corner cupboard, or it is supported in the downward direction and in the direction in which it is rotated around the supporting column on a transverse pin which can be inserted through holes in the supporting column. The transverse pin is received by the underside of the first rotary bearing component. The second rotary bearing component supports a shelf in the form of three quarters of a circle. The cut-out in the shelf points in a defined direction when the projection on the upper side of the first rotary bearing component is engaged in the recess in the underside of the second rotary bearing component. When all the shelves are so orientated, the corner cupboard can be closed, because the shelves do not project through the door opening of the corner cupboard. All the shelves can be rotated individually, the projection on the upper side of the first rotary bearing component coming out of the recess in the underside of the second rotary bearing component and the given shelf then being supported in the downward direction, at the underside of the second rotary bearing component, only on the projection on the upper side of the first rotary bearing component until it returns to its starting position.

A rotary fitting in which a shelf is supported in the downward direction directly on a transverse pin which extends transversely through a supporting column is known from a product "Lazy Daisy". The transverse pin is composed of plastics material and comprises a head whose diameter is enlarged as compared to that of its shank and which has arcuate clamping arms which in the circumferential direction extend around the supporting column from the head to secure the transverse pin in place in the supporting column. A rotary bearing component of the associated shelf has, on the underside, two circular tracks which are arranged with an offset in the vertical direction and which extend around the supporting column and of which one is supported on the head of the transverse pin and the other on the free end of the transverse pin, which projects through the supporting column. Both circular tracks have recesses here. The two recesses are offset from one another at 180°, and the head of the transverse pin and its free end thus enter the two recesses simultaneously and in this way define a given position in rotation for the rotary shelf.

There is still a need for a rotary fitting for a corner cupboard in which the loading on the material is more even, when the article-carrying member is rotated.

SUMMARY OF THE INVENTION

In a first aspect, the invention provides a corner cupboard, the rotary fitting comprising a supporting column; fastening members for the supporting column to hold the supporting column in a vertical orientation and fixed in rotation in the corner cupboard; at least one article-carrying member rotating about the supporting column; and a rotary bearing between the supporting column and the at least one article-carrying member. The rotary bearing has a first rotary bearing component which is provided to be mounted on the supporting column in such a way as to be fixed in position and in rotation thereon, and a second rotary bearing component which is provided to be mounted on the article-carrying member in such a way as to be fixed in position and in rotation thereon. The first rotary bearing component has an upper side on which at least three circular tracks are provided, these circular tracks extending round the supporting column, extending substantially horizontally when the supporting column is vertically orientated, and each comprising a lower portion and an upper portion with a vertical difference in level between the lower portion and the upper portion of the track and two sloping regions, arranged between the lower portion and the upper portion of the track, which slope in opposite directions around the supporting column, the vertical differences in level between the lower and upper portions of all the circular tracks being of the same size, the two sloping regions which slope in opposite directions of all the circular tracks being spaced at substantially equal angular intervals around the supporting column in the circumferential direction, and the sloping regions which slope in the same direction of all the circular tracks being at the same slopes around the supporting column and being arranged to be distributed around the supporting column. The second rotary bearing component has an underside on which one complementary circular track having lower and upper portions and sloping regions which slope in opposite directions is provided per each circular track on the upper side of the first rotary bearing component.

In a more detailed aspect, the invention provides a corner cupboard, the rotary fitting comprising a supporting column; fastening members for the supporting column to hold the supporting column in a vertical orientation and fixed in rotation in the corner cupboard; at least one article-carrying member rotating about the supporting column; and a rotary bearing between the supporting column and the at least one article-carrying member. The rotary bearing has a first rotary bearing component which is provided to be mounted on the supporting column in such a way as to be fixed in position and in rotation thereon, and a second rotary bearing component which is provided to be mounted on the article-carrying member in such a way as to be fixed in position and in rotation thereon. The first rotary bearing component has an upper side on which at least three circular tracks are provided, these circular tracks extending round the supporting column, extending substantially horizontally when the supporting column is vertically orientated, and each comprising a lower portion and an upper portion with a vertical difference in level between the lower portion and the upper portion of the track and two sloping regions, arranged between the lower portion and the upper portion of the track, which slope in opposite directions around the supporting column, the vertical differences in level between the lower and upper portions of all the circular tracks being of the same size, the two sloping regions which slope in opposite directions of all the circular tracks being spaced at substantially equal angular intervals around the supporting column in the circumferential direction, the two sloping regions which slope in opposite directions of all the circular tracks being at an angular interval in the circumferential direction around the supporting column ranging from 5° to 60°, the sloping regions which slope in the same direction of all the circular tracks being at the same slopes around the supporting column and being arranged to be distributed around the supporting column, and all transitions between the portions of the tracks and the sloping regions being rounded. The second rotary bearing component has an underside on which one complementary circular track having lower and upper portions and sloping regions which slope in opposite directions is provided per each circular track on the upper side of the first rotary bearing component.

BRIEF DESCRIPTION OF THE DRAWINGS

The invention will be better understood by considering the following drawings. The parts are not necessarily shown to scale in the drawings and instead the emphasis has been placed on illustrating the principles of the invention clearly. In the drawings the same reference numerals denote the same parts in the different views.

DETAILED DESCRIPTION

Figure 1:
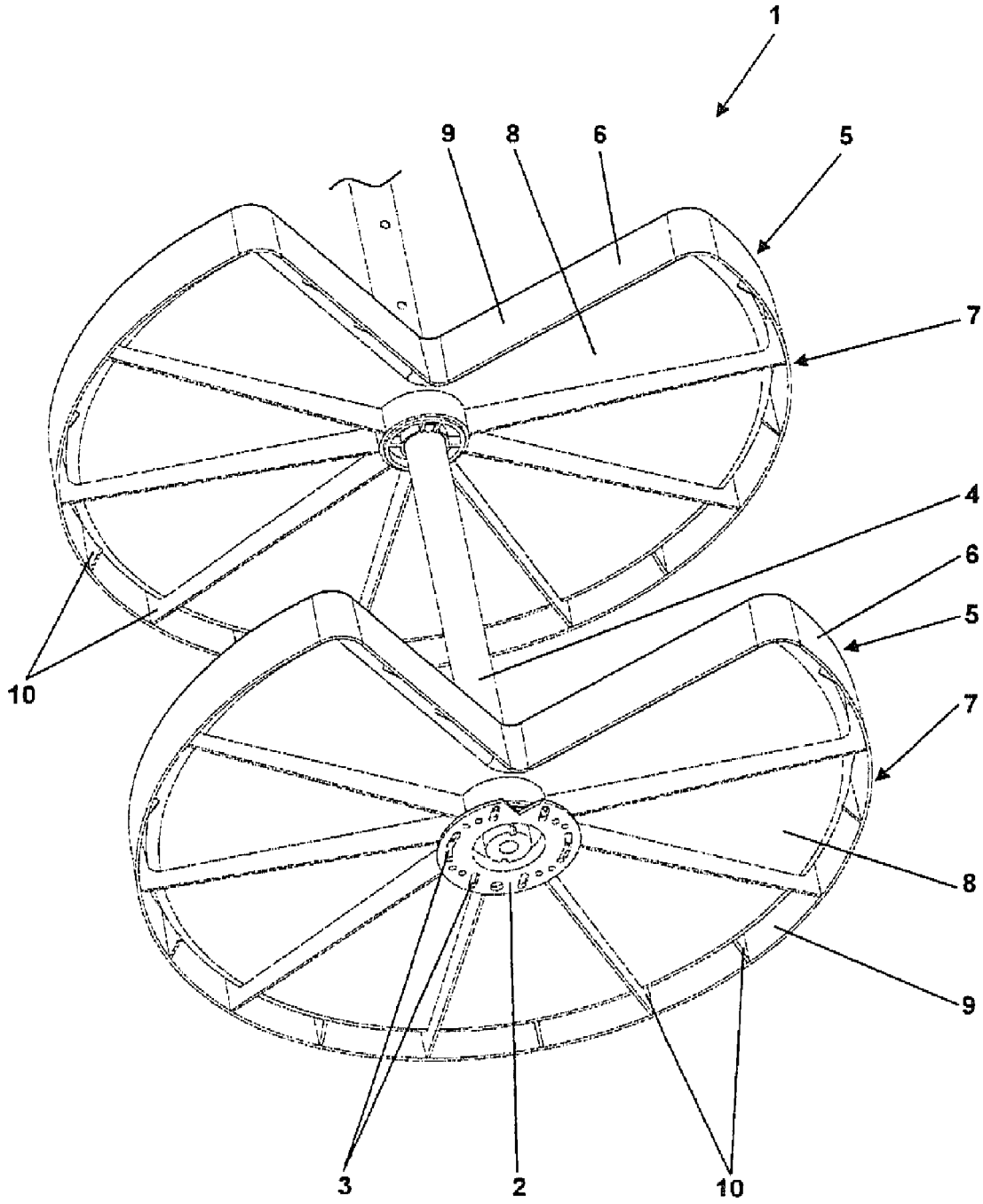
FIG. 1 is a perspective three-quarter view from below of a rotary fitting for a corner cupboard having two shelves.

In the new rotary fitting, each article-carrying member is supported on the supporting column via one rotary bearing. This rotary bearing has a first rotary bearing component which is attached to the supporting column to be fixed in position and in rotation thereon and a second rotary bearing component which is connected to the given object-carrying member to be fixed in position and in rotation thereon. Provided on the upper side of the first rotary bearing component are circular tracks which extend round the supporting column and which extend substantially horizontally when the supporting column is vertically orientated. Each circular track comprises a lower horizontal portion and an upper horizontal portion with a vertical difference in level between these two portions of the track. This vertical difference in level is bridged by sloping regions of the circular tracks in which the circular tracks do not extend horizontally but slope around the supporting column. The two sloping regions of each circular track slope in opposite directions around the supporting column. The vertical differences in level between the lower and upper portions are of the same size on all the circular tracks; and the sloping regions which slope in the same direction of all the circular tracks are at the same slope around the supporting column. Further, the two sloping regions which slope in opposite directions of all the circular tracks are spaced at equal angular intervals in the circumferential direction around the supporting column, and the sloping regions which slope in the same direction of all the circular tracks are arranged to be distributed around the supporting column, preferably evenly.

Because circular tracks on the underside of the second rotary bearing component are formed to be complementary to the same circular tracks on the upper side of the first rotary bearing component, the circular tracks rest against one another over their entire circumferential extent around the supporting column when the two rotary bearing components are in a certain relative position. The two rotary bearing components can be rotated relative to one another, out of this relative position, around the supporting column. However, the rotary movement also calls for the two rotary bearing components to move out of engagement with one another in the direction defined by the supporting column, in order to bridge the vertical difference in level between the lower and upper portions of the circular tracks. The bridging of the vertical difference in level requires a force which is the result of the weight-generated force from the given article-carrying member which the second rotary bearing component is supporting. The size of the force also depends on the slope of the sloping regions of the circular tracks around the supporting column. Once the vertical difference in level has been bridged, the two rotary bearing components can continue to be rotated relative to one another without any force to be overcome other than the friction between the upper portions of track on the first rotary bearing component fastened to the supporting column and the lower portions of track on the second rotary bearing component fastened to the article-carrying member.

If the extension, in the circumferential direction around the supporting column, of the upper portions of track on the upper side of the first rotary bearing component and of the lower portions of track on the underside of the second rotary bearing component is not comparatively short, there is a constant variation in the size of the regions in which the upper and lower portions of track are in contact. However, the regions in which the two rotary bearing components are in contact are in any case distributed around the supporting column because the sloping regions which slope in the same direction on all the circular tracks are arranged to be distributed around the supporting column. Thus, the sloping regions which slope in the same direction on all the tracks may be arranged at intervals of 120° around the supporting column. This produces regions in contact whose centers are likewise spaced at such an interval around the supporting column. The result is that, via a second rotary bearing component, each article-carrying member is supported on the supporting column at three points distributed around the supporting column on a first rotary bearing component. Three-point support is well known to have geometrical advantages.

Relatively short regions in contact between the circular tracks on the underside of the second rotary bearing component and on the upper side of the first rotary bearing component have the advantage of providing constant conditions throughout the rotary movement of the given article-carrying member around the supporting column. In concrete terms, what is found to be beneficial is an extension of 5° to 60° around the supporting column. For their part, the regions in contact remain fixed in this case when the upper portions of all the circular tracks on the upper side of the first rotary bearing component only extend for this angular interval of 5° to 60°. On the other hand, the regions in contact move around the supporting column, if the lower portions of all the circular tracks on the upper side of the first rotary bearing member each extend for the angular interval ranging from 5° to 60°. The respective other portions of the tracks which extend around the supporting column for the remaining angle may extend in common respective planes on the two rotary bearing components. These portions of tracks may merge into one another directly, i.e. with no separation between the respective circular tracks.

All transitions between the portions of the circular tracks and their sloping regions are advantageously rounded to avoid any point loads on the material. The sloping regions as such may be kept relatively short and may for example each extend over an angle ranging from 10° to 40°.

The first rotary bearing component may be supported in the downward direction and in the circumferential direction around the supporting column on a transverse pin which extends through the supporting column. The first rotary bearing component may however equally well be supported on a lower fastening member for the supporting column.

The second rotary bearing component may be designed and provided for being inserted into the given article-carrying member from below and to make to the latter a connection which is fixed in rotation therewith. It is preferable for the second rotary bearing component to be composed of a plastics material which is particularly free-sliding. It may then also form surfaces for sliding between the article-carrying member and the supporting column to reduce the friction against the supporting column when there are rotary movements of the article-carrying member. Basically, the first rotary bearing component and/or the second rotary bearing component may each be injection moulded from plastics material as one-piece mouldings.

The article-carrying member too may be injection moulded from plastics material and may for example be a shelf. It may however equally well be a basket.

The horizontal dimensions of the article-carrying member are typically those of a circle from which a sector is cut out. The horizontal dimensions of the article-carrying member may, very particularly, be substantially those of three-quarters of a circle.

Referring now in detail to the drawings, FIG. 1 shows a rotary fitting 1 for a corner cupboard (not shown). The rotary fitting 1 has a bottom fastening member 2 having a plurality of fastening holes 3 of different shapes. The fastening holes 3 allow fastening screws to pass through them to enable the fastening member 2 to be screwed to a floor panel of the corner cupboard. The fastening member 2 holds the bottom end of a supporting column 4, the supporting column 4 being connected to the fastening member 2 to be fixed in rotation therewith. The top end of the supporting column 4 is likewise fastened to the corner cupboard by a fastening member or a plurality of fastening members. These latter fastening members are not shown in FIG. 1. Instead, the top end of the supporting column 4 is shown cut off there. Rotatably mounted on the supporting column 4 in such a way as to be able to be turned around it are two article-carrying members 5 in the form of shelves 6. The shelves 6 are substantially in the form of three-quarters of circles. The cut-out which is missing from each of the shelves 6 allows the given corner cupboard to be closed. When the corner cupboard is open, part of each shelf 6 can be moved out of the corner cupboard by rotating the latter round the supporting column 4, to enable easy access to be gained to the articles arranged on the shelf. The shelves 6 are one-piece shaped bodies 7 of plastics material having a main plate 8, a rim 9 and reinforcing ribs 10.

Figure 2:
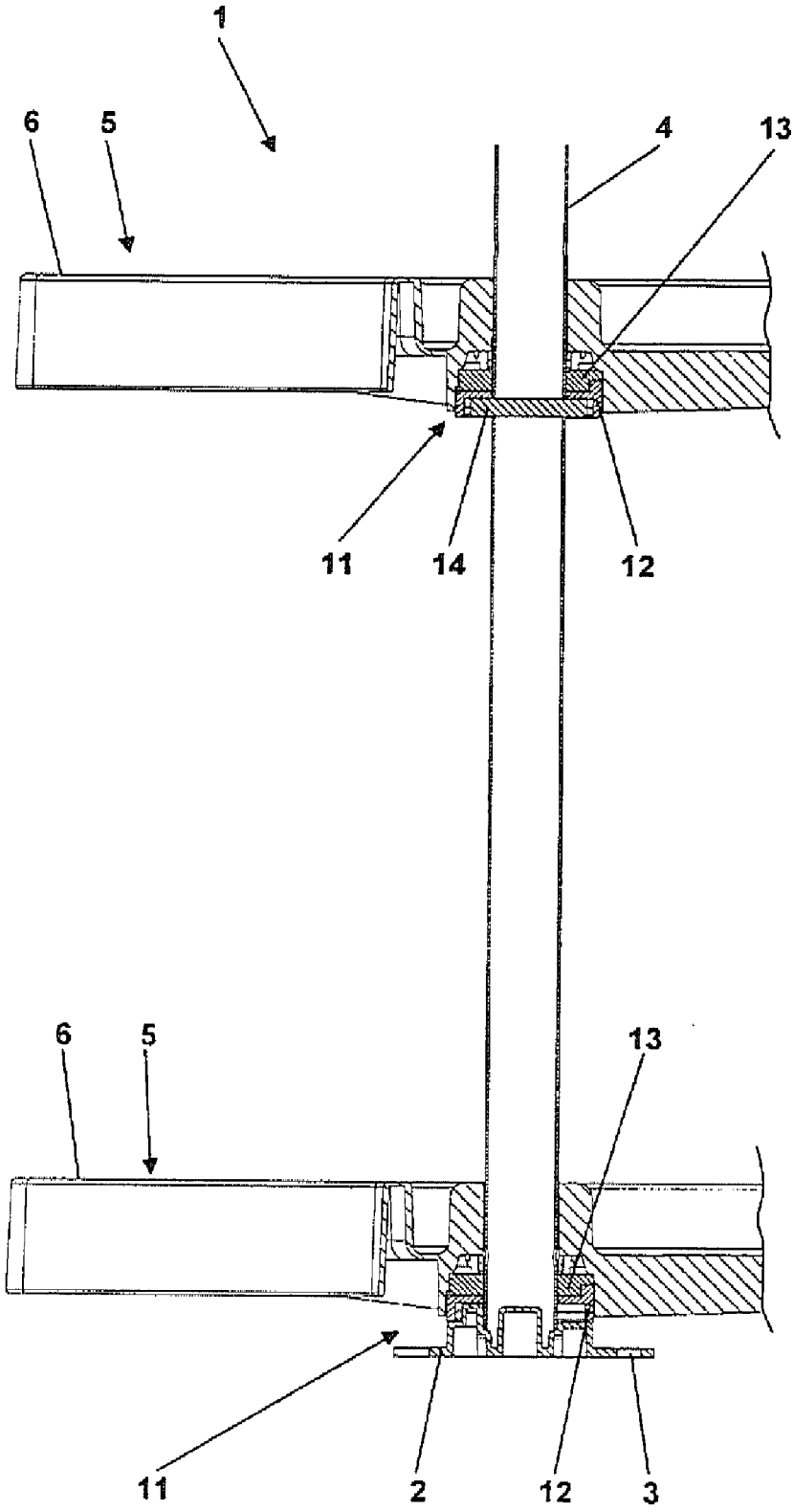
FIG. 2 is a vertical section through the rotary fitting shown in FIG. 1.

The vertical section shown in FIG. 2 though the rotary fitting shown in FIG. 1, in which the article-carrying members are not shown in full but are cut off on the right-hand side, shows that the article-carrying members are each mounted on the supporting column 4 by means of a rotary bearing 11. Each rotary bearing 11 comprises a first rotary bearing component 12 which is mounted on the supporting column 4 to be solid in rotation therewith and a second rotary bearing component 13 which is mounted on the given article-carrying member 5 to be solid in rotation with that. The first rotary bearing component 12 of the lower of the two rotary bearings 11 for the lower of the two article-carrying members 5 is supported on the fastening member 2 and is fastened in place to be immobile around the supporting column 4 in the circumferential direction. The first rotary bearing component 12 of the upper rotary bearing 11 for the upper article-carrying member 5 on the other hand is supported both in the vertical direction and in the circumferential direction around the supporting column 4 on a transverse pin 14, in the manner which is known from U.S. Pat. No. 5,279,429.

Figure 3:
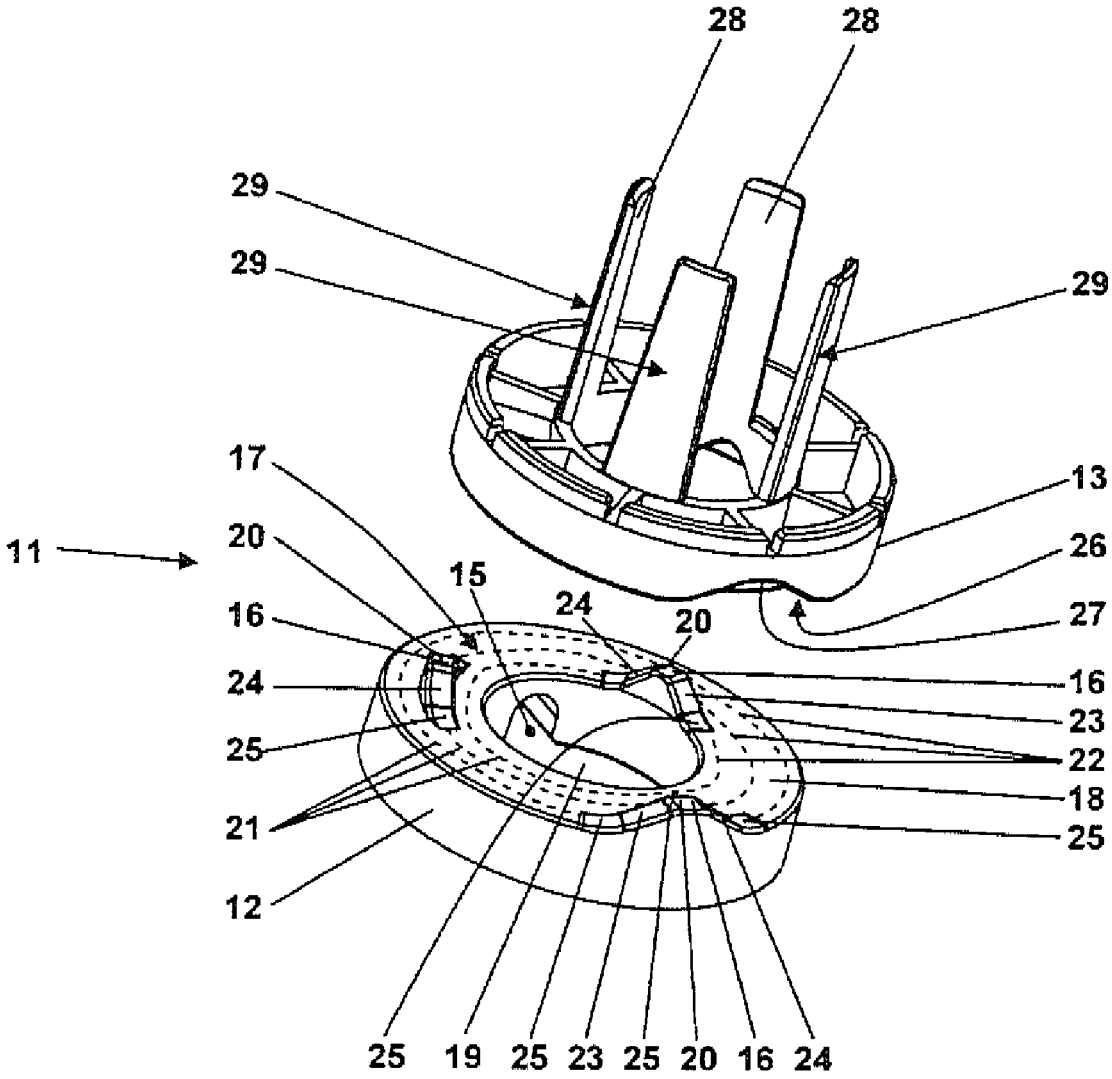
FIG. 3 is an exploded view of two rotary bearing components of the rotary fitting shown in FIG. 1.

The exploded view of FIG. 3 shows the first rotary bearing component 12 and the second rotary bearing component 13 of one of the two rotary bearings 11 shown in FIG. 2. As well as a receptacle 15 for the transverse pin 14 shown in FIG. 2, what can be seen in the case of the first rotary bearing component 12 are a plurality of projections 16 which, on the upper side 17 of the rotary bearing component 12, project upwards from a plane 18 which is horizontally aligned in the case of the rotary fitting 1 shown in FIG. 2. These projections 16 are at different distances from a central aperture 19 in the rotary bearing component 12 through which, in the case of the rotary bearing 1 shown in FIG. 2, the supporting column 4 passes. The projections 16 are thus upper portions 20 of respective ones of three circular tracks 21 which are formed on the upper side 17 and which comprise, as well as the upper portions 20, lower portions 22 and sloping regions 23 and 24. All transitions 25 between the portions 20 and 22 of the tracks and the sloping regions 23 and 24 are rounded. Also, the projections 16, or in other words the upper portions 20 of the tracks, on the upper side 17 of the first rotary bearing component 12 are evenly distributed around the aperture 19. They are also at equal heights above the plane 18 and the sloping regions 23 and 24 are also at the same slopes around the aperture 19. However, the slopes of the sloping regions 23 are in the opposite direction to the slopes of the sloping regions 24. The underside 26 of the second rotary bearing component 13 is provided with circular tracks complementary to the circular tracks 22. Of these, all that can be seen in FIG. 3 is an upper portion 27 of a circular track on the underside 26 of the second rotary bearing component 13, which upper portion 27 corresponds to the upper portion 20 of the outer circular track on the upper side of the rotary bearing component 12. It can also be seen from FIG. 3 that there are formed on the second rotary bearing component 13, on fins 29, surfaces for sliding 28 by means of which the particularly free-sliding plastics material of the rotary bearing component 13 is able to slide on the supporting column 4 when the given article-carrying member 5 is rotated around the supporting column 4 shown in FIG. 2.

Figure 4:
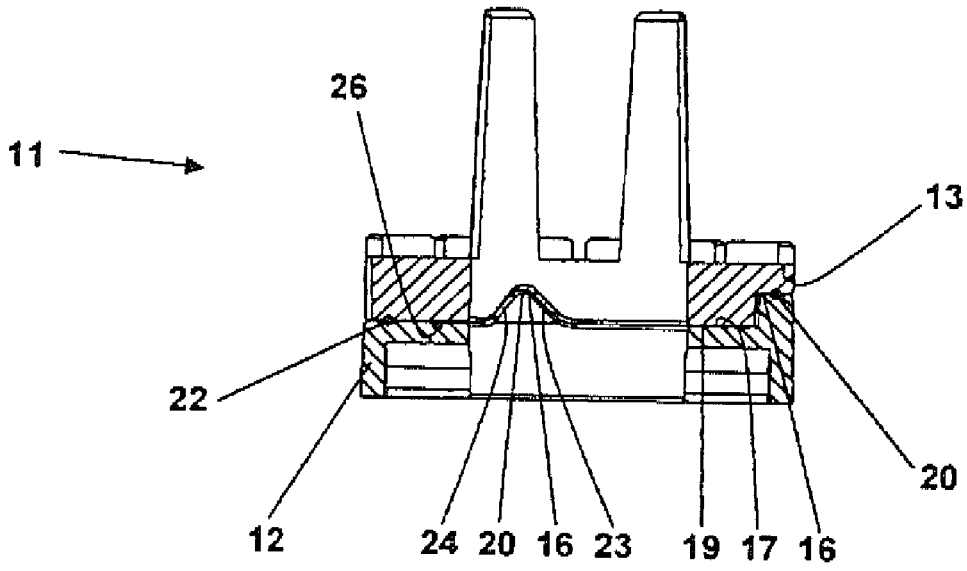
FIG. 4 is a vertical section through the two rotary bearing components shown in FIG. 3 in a first relative position in the circumferential direction.
Figure 5:
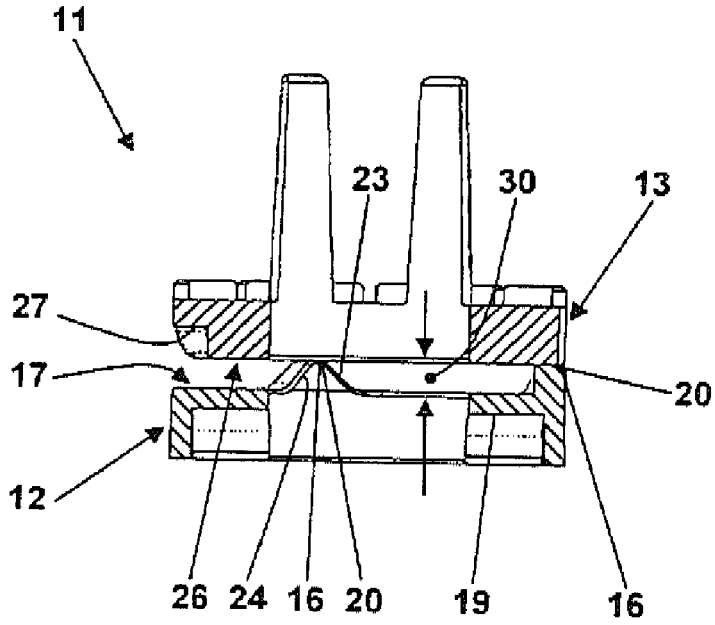
FIG. 5 is a vertical section through the two rotary bearing components shown in FIGS. 3 and 4 in a second relative position in the circumferential direction.

FIG. 4 is a section through the rotary bearing 11 shown in FIG. 3, in which the underside 26 of the second rotary bearing component 13 is resting directly on the upper side 17 of the first rotary bearing component 12, with the respective circular tracks also being in contact over the whole of their area. Such contact also exists over the sloping regions 23 and 24 and the upper portions 20 of the tracks. The relative position of the two rotary bearing components 12 and 13 in FIG. 4 also defines that position of the article-carrying members 15 in which their cut-outs are aligned with the door opening of the given corner cupboard. The two rotary bearing components 12 are only able to leave this relative position if, as it is rotated, the second rotary bearing component 13 is also raised relative to the first rotary bearing component until the second rotary bearing component 13 is resting only on the projections 16 or on the upper portions 20 of the tracks in the way shown in FIG. 5. Even when the rotary bearing components 12 and 13 are in the relative position shown in FIG. 5, the given article-carrying member is stably supported at three points distributed around the supporting column. This gives an even distribution of the forces applied at the points in contact. The distribution of the sloping regions 23 and 24 around the supporting column also makes it easier for the given article-carrying member to be raised through the vertical difference in level 30. However, as soon as the given article-carrying member is again aligned with its cut-out towards the door opening of the corner cupboard, it automatically moves down through the vertical difference in level 30, as a result of which the rotary bearing 11 again reaches its position shown in FIG. 4.

Many variations and modification may be made to the preferred embodiments of the invention without departing from the essence and principles of the invention. All such variations and modifications are provided to be included within the scope of the present invention as defined by the following claims.

I claim:

1. A rotary fitting for a corner cupboard, the rotary fitting comprising:

a supporting column;

fastening members for the supporting column which are designed and provided for holding the supporting column in a vertical orientation and fixed in rotation in the corner cupboard;

at least one article-carrying member rotating about the supporting column; and a rotary bearing between the supporting column and the at least one article-carrying member, the rotary bearing having:

a first rotary bearing component which is provided to be mounted on the supporting column in such a way as to be fixed in position and in rotation thereon and which has an upper side on which at least three circular tracks are provided, these circular tracks:

extending round the supporting column, extending substantially horizontally when the supporting column is vertically orientated, and each comprising a lower portion and an upper portion with a vertical difference in level between the lower portion and the upper portion of the track and two sloping regions, arranged between the lower portion and the upper portion of the track, which slope in opposite directions around the supporting column, the vertical differences in level between the lower and upper portions of all the circular tracks being of the same size, the two sloping regions which slope in opposite directions of all the circular tracks being spaced at substantially equal angular intervals around the supporting column in the circumferential direction, and the sloping regions which slope in the same direction of all the circular tracks being at the same slopes around the supporting column and being arranged to be distributed around the supporting column, and a second rotary bearing component which is provided to be mounted on the article-carrying member in such a way as to be fixed in position and in rotation thereon and which has an underside on which one complementary circular track having lower and upper portions and sloping regions which slope in opposite directions is provided per each circular track on the upper side of the first rotary bearing component.

2. The rotary fitting according to claim 1, wherein the sloping regions which slope in the same direction are arranged to be evenly distributed around the supporting column.

3. The rotary fitting according to claim 2, wherein the two sloping regions which slope in opposite directions of all the circular tracks are at an angular interval in the circumferential direction around the supporting column ranging from 5° to 60°.

4. The rotary fitting according to claim 3, wherein the upper portions of all the circular tracks on the upper side of the first rotary bearing component each extend over the angular interval ranging from 5° to 60°.

5. The rotary fitting according to claim 4, wherein the lower portions of all the circular tracks on the upper side of the first rotary bearing component extend in one plane.

6. The rotary fitting according to claim 3, wherein the lower portions of all the circular tracks on the upper side of the first rotary bearing component each extend over the angular interval ranging from 5° to 60°.

7. The rotary fitting according to claim 6, wherein the upper portions of all the circular tracks on the upper side of the first rotary bearing component extend in one plane.

8. The rotary fitting according to claim 1, wherein all transitions between the portions of the tracks and the sloping regions are rounded.

9. The rotary fitting according to claim 1, wherein the first rotary bearing component is designed and provided for being supported in the downward direction and in the circumferential direction on a transverse pin which extends through the supporting column.

10. The rotary fitting according to claim 1, wherein the first rotary bearing component is designed and provided for being supported in the downward direction and in the circumferential direction on a lower one of the fastening members for the supporting column.

11. The rotary fitting according to claim 1, wherein the second rotary bearing component is designed and provided for being inserted into the article-carrying member from below and for making a connection with the latter which is fixed in rotation.

12. The rotary fitting according to claim 1, wherein the second rotary bearing component forms sliding surfaces between the article-carrying member and the supporting column which are composed of free-sliding plastics material.

13. The rotary fitting according to claim 1, wherein the first rotary bearing component and the second rotary bearing component are each injection moulded from plastics material as one-piece mouldings.

14. The rotary fitting according to claim 1, wherein the article-carrying member is selected from the group comprising baskets and shelves.

15. The rotary fitting according to claim 1, wherein a horizontal dimensions of the article-carrying member are substantially those of a circle from which a sector is cut out.

16. The rotary fitting according to claim 15, wherein the horizontal dimensions of the article-carrying member is substantially those of three-quarters of a circle.

17. A rotary fitting according to claim 1, wherein the two rotary bearing components have:

a certain relative position in the circumferential direction around the supporting column in which the circular tracks on the underside of the second rotary bearing component rest on the circular tracks on the upper side of the first rotary bearing component over substantially their entire circumferential extent around the supporting column, and a plurality of relative positions in the circumferential direction about the supporting column in which the lower portions of the circular tracks on the underside of the second rotary bearing component rest locally on the upper portions of the circular tracks on the upper side of the first rotary bearing component, the vertical level of the article-carrying member in the plurality of relative positions of the rotary bearing components being higher by a constant amount than in the one certain relative position of the rotary bearing components.

18. A rotary fitting for a corner cupboard, the rotary fitting comprising:

a supporting column;

fastening members for the supporting column which are designed and provided for holding the supporting column in a vertical orientation and fixed in rotation in the corner cupboard;

at least one article-carrying member rotating about the supporting column; and a rotary bearing between the supporting column and the at least one article-carrying member, the rotary bearing having:

a first rotary bearing component which is provided to be mounted on the supporting column in such a way as to be fixed in position and in rotation thereon and which has an upper side on which at least three circular tracks are provided, these circular tracks:

extending round the supporting column, extending substantially horizontally when the supporting column is vertically orientated, and each comprising a lower portion and an upper portion with a vertical difference in level between the lower portion and the upper portion of the track and two sloping regions, arranged between the lower portion and the upper portion of the track, which slope in opposite directions around the supporting column, the vertical differences in level between the lower and upper portions of all the circular tracks being of the same size, the two sloping regions which slope in opposite directions of all the circular tracks being spaced at substantially equal angular intervals around the supporting column in the circumferential direction, the two sloping regions which slope in opposite directions of all the circular tracks being at an angular interval in the circumferential direction around the supporting column ranging from 5° to 60°, the sloping regions which slope in the same direction of all the circular tracks being at the same slopes around the supporting column and being arranged to be distributed around the supporting column, and all transitions between the portions of the tracks and the sloping regions being rounded, and a second rotary bearing component which is provided to be mounted on the article-carrying member in such a way as to be fixed in position and in rotation thereon and which has an underside on which one complementary circular track having lower and upper portions and sloping regions which slope in opposite directions is provided per each circular track on the upper side of the first rotary bearing component.

19. The rotary fitting according to claim 18, wherein the first rotary bearing component is designed and provided for being supported in the downward direction and in the circumferential direction on a transverse pin which extends through the supporting column.

20. The rotary fitting according to claim 18, wherein the first rotary bearing component is designed and provided for being supported in the downward direction and in the circumferential direction on a lower one of the fastening members for the supporting column.

21. The rotary fitting according to claim 18, wherein the second rotary bearing component is designed and provided for being inserted into the article-carrying member from below and to make to the latter a connection which is fixed in rotation therewith.

22. The rotary fitting according to claim 18, wherein the second rotary bearing component forms sliding surfaces between the article-carrying member and the supporting column which are composed of free-sliding plastics material.

23. The rotary fitting according to claim 18, wherein the first rotary bearing component and the second rotary bearing component are each injection moulded from plastics material as one-piece mouldings.

24. The rotary fitting according to claim 18, wherein the article-carrying member is selected from the group comprising baskets and shelves, a horizontal extent of the article-carrying member comprising substantially three-quarters of a circle.

25. The rotary fitting according to claim 18, wherein the two rotary bearing components have:

a certain relative position in the circumferential direction around the supporting column in which the circular tracks on the underside of the second rotary bearing component rest on the circular tracks on the upper side of the first rotary bearing component over substantially their entire circumferential extent around the supporting column, and a plurality of relative positions in the circumferential direction about the supporting column in which the lower portions of the circular tracks on the underside of the second rotary bearing component rest locally on the upper portions of the circular tracks on the upper side of the first rotary bearing component, the vertical level of the article-carrying member in the plurality of relative positions of the rotary bearing components being higher by a constant amount than in the one certain relative position of the rotary bearing components.

* * * * *